US007169091B2

(12) United States Patent
St. George et al.

(10) Patent No.: US 7,169,091 B2
(45) Date of Patent: Jan. 30, 2007

(54) SKIPPING ROPE OR JUMP ROPE HAVING IMPROVED ASYMMETRIC HANDLE

(76) Inventors: David St. George, 86 Duke of York Square, London (GB) SW3 4LY; Clayton O'Shea, 72 Westacott Close, London (GB) NI9 31F ( * ) Notice: Subject to any disclaimer, the term of this patent is extended or adjusted under 35 U.S.C. 154(b) by 0 days.

(21) Appl. No.: 10/372,760

(22) Filed: Feb. 24, 2003

(65) Prior Publication Data

US 2006/0035761 A1 Feb. 16, 2006

Related U.S. Application Data

(63) Continuation-in-part of application No. 09/774,376, filed on Jan. 31, 2001, now Pat. No. 6,544,149.

(30) Foreign Application Priority Data

Feb. 1, 2000 (GB) ..... 0002337.4

(51) Int. Cl.
*A63B 21/00* (2006.01)

(52) U.S. Cl. ..... 482/82; 482/126; 482/81

(58) Field of Classification Search ..... 482/126, 482/121, 148, 81, 124, 74, 904, 907, 82
See application file for complete search history.

(56) References Cited

U.S. PATENT DOCUMENTS 1,436,703 A * 11/1922 Fisher ..... 482/82
1,584,122 A 5/1926 Moore
2,719,038 A 9/1955 Massa
3,415,515 A 12/1968 Otto
3,419,270 A 12/1968 Eppy
3,419,720 A * 12/1968 Debye et al. ..... 250/337
4,090,705 A 5/1978 Young
4,293,125 A * 10/1981 Hinds ..... 482/82
4,505,474 A 3/1985 Mattox
4,787,624 A 11/1988 Grant
4,801,137 A 1/1989 Douglass
4,890,829 A 1/1990 Burton (Continued)

FOREIGN PATENT DOCUMENTS

FR 2366848 * 8/1976

(Continued)

*Primary Examiner*—Jerome W. Donnelly
(74) *Attorney, Agent, or Firm*—Buckley, Maschoff & Talwalkar LLC

(57) ABSTRACT

In accordance herewith, a handle of a skipping rope is substantially shaped like a "T" with the vertical stroke or elongate portion of the T at one end, swivellably connected to a rope, and the other end, connected to a crosspiece or transverse portion of the T. The handle may be held in a hand with the crosspiece of the T situated between fingers and palm and with the elongate portion extending between two fingers. The crosspiece or transverse portion of the handle is asymmetric, and adapted to fit to a hand that is holding the handle with the elongate portion passing between two fingers of the hand other than the second (index) and third (middle) fingers. This provides a comfortable and effective skipping position, allowing the crosspiece portion of the handle to be in contact with all the fingers and/or the full width of the palm.

11 Claims, 10 Drawing Sheets

U.S. PATENT DOCUMENTS

| | | | | |
|---|---|---|---|---|
| 5,215,509 | A | 6/1993 | Meyer | |
| 5,372,558 | A | 12/1994 | Perry et al. | |
| 5,533,952 | A * | 7/1996 | Schaber | 482/70 |

FOREIGN PATENT DOCUMENTS

| | | | |
|---|---|---|---|
| FR | 2 366 848 | | 5/1978 |
| GB | 161388 | | 4/1921 |
| GB | 875750 | | 8/1961 |
| GB | 2 166 058 | A | 4/1986 |
| GB | 2 189 160 | A | 10/1987 |
| WO | WO 99/38574 | A1 | 8/1999 |
| WO | WO 01/56660 | A1 | 8/2001 |

* cited by examiner

SKIPPING ROPE OR JUMP ROPE HAVING IMPROVED ASYMMETRIC HANDLE

CROSS REFERENCE TO RELATED APPLICATIONS

This application claims priority of, and is a continuation-in-part of application Ser. No. 09/774,376, U.S. Pat. No. 6,544,149, filed 31 Jan. 2001, which claims priority from UK 0002337.4 filed 01 Feb. 2000; both of which, in their entirety, are hereby incorporated by reference.

TECHNICAL FIELD

This invention relates to skipping ropes in general, and in particular to an improved skipping rope handle.

BACKGROUND OF THE INVENTION

Skipping or jumping ropes have been known for centuries and constitute both a children's activity plaything and a serious device for promoting health and fitness. The exercise of "skipping" (also known as "jumping rope") is one which can have substantial beneficial effects. It is particularly practiced by boxers in order to build up muscle strength and tone as well as sharpening reactions.

Conventional skipping ropes consist of a length of flexible material such as rope or a plastics substitute for rope with a handle at each end.

Generally speaking, the handle is an elongate member which, if held up by the rope, extends vertically. While not absolutely necessary, most skipping ropes enable the rope to swivel about the elongate axis of the handle in order that, as the loop of rope is turned around the body of the person skipping during that activity, it does not undergo twisting.

The conventional disposition of handles and swivel mechanisms is not ideal, particularly for serious skipping, for a number of reasons:

First the holding position of the handles is somewhat awkward; with the handles held extending across the palm of the hand, and held against that by the curled fingers and the thumb, in order to position the handle horizontally and with the end from which the rope extends remote from the skipper's body, the arms must be turned outwards around their longitudinal axis, i.e. each hand must be supinated, in anatomical terms, such that the thumb is turned away from the body. This is not particularly comfortable, compared with the relaxed position of the hands when the arms are simply allowed to hang at a person's sides, where the palms face inwards. This relaxed position, or "rest" position is, in anatomical terms, between the pronated position and supinated position. The rest position is characterized by the palms of each hand each facing inwards towards the body, with the thumbs being on the front side of the body.

Secondly, the swivel mechanism introduces friction and drag which, at high skipping speeds, can be substantial.

Also, at high skipping speeds it is easy for the handle to slip axially within the hand, or even, due to the high pull from the rotating rope, slip out from the hand entirely. If slippage is compensated by the skipper attempting to shift the handle inwards, this can easily lead to the handle being moved so far in that the rotating rope then starts to chafe at the knuckles of the thumb and first finger, which is naturally undesirable. Minimizing or preventing slippage with such a handle is not easy, and often requires the user to clench the grip more tightly.

An approach to address these concerns about conventional skipping ropes is disclosed in U.S. patent application Ser. No. 09/774,376, filed 31 Jan. 2001, which discloses a skipping rope characterized by having a handle at each end which consists of an elongate portion attached to one end of the rope and a portion transverse thereto at its outer end. This provides a type of "T-bar" handle, with much improved grip.

When using such a skipping rope, the transverse portion can be held easily effectively in the palm of the hand with the elongate portion extending between two fingers. This gives a much more comfortable skipping position as well as a considerably more slip-proof one, even if the hand becomes sweaty. The transverse portion of the handle nestles within the curled up fingers (which are naturally characteristic of the hand at rest) while the elongate portion extends between two of the fingers. When held in the center of the hand, the elongate portion would pass between the second (middle) and third (ring) fingers. The effective grip, e.g. the ability to retain the handle and to resist the rope attempting to, escape the user's grip is much stronger, and the distribution of forces is better configured with the base of the fingers taking the strain rather than the forefinger and thumb doing so (as is the case in an ordinary handle which must be firmly gripped by the thumb and forefinger); thus, clenching is not needed, in contrast to the clenching often needed by the user of a conventional handle. This can be of particular importance if the skipper does not have a strong grip, for example due to arthritis, injury or even deformity in the hand or hands. The position is much more secure, being more in the nature of a mechanical interlock than a friction grip. The hands are also held at the sides without twisting the arms, i.e. with the backs (a.k.a. dorsal sides) of the hands facing outwards on opposite sides of the skipper's body; in anatomical terms, it may be said that the hands are held at the sides without requiring supination of the wrist, hand, or arm.

As mentioned above, and as particularly noticed in and disclosed in the aforementioned application Ser. No. 09/774,376, from which the present application is a continuation-in-part, it was found desirable for the elongate portion to extend between two of the fingers, and the transverse portion of the handle to be symmetric with respect to the position of the elongate portion. While such a configuration has many advantages, particularly (but not exclusively) when it is held so that the elongate portion passes between the second (middle) and third (ring) fingers, when the handle is held such that the elongate portion passes between the first (a.k.a. index) and second (a.k.a. middle) fingers the transverse portion is substantially, if not completely, in contact only with the index and middle fingers. Moreover, if that same handle is held such that the elongate portion passes between the third (a.k.a. ring) finger and fourth (a.k.a. little) finger, the transverse portion is substantially, if not completely, in contact only with the ring finger and the little finger. Thus, when the elongate portion of the handle is between the ring and little finger, or between the index finger and middle finger, the user of the handle disclosed in the parent application does not feel the transverse portion across all the fingers of his hand and may subjectively experience this as an uncomfortable feeling and/or a less-than-optimal grip; such a user may prefer feeling a handle with the transverse portion sized so as to be felt across all-the fingers of his or her hand. (It should be understood that, with the handle of the above-cited parent application, such a feeling may be provided, if at all, only when the elongate portion is held between the second (middle) and third (ring) fingers of the hand.)

BRIEF SUMMARY OF THE INVENTION

In accordance with the present invention, there is disclosed a handle for a rope having an improved design. More specifically, in accordance with the present invention, the transverse portion of the handle is not symmetric, it is asymmetric, having two sub-portions of unequal length, such that, when the handle is held such that the elongate portion passes between the index finger and the middle finger, the sub-portions of the transverse portion are appropriately sized so as to be in contact, not with only the index finger and middle finger, but with the index finger, middle finger, ring finger, and little finger. Similarly, when the handle is held such that the elongate portion passes between the ring finger and the little finger, the sub-portions of the transverse portion are appropriately sized so as to be in contact, not with only the little finger and the ring finger, but to be in contact with the little finger, ring finger, middle finger, and index finger. Thus, the improved handle of the present application, i.e., a handle having a transverse portion which is asymmetric in relation to the elongate portion to which it is joined, is seen to be particularly suited for holding the handle such that the elongate portion passes between the fingers other than the middle finger and ring finger.

The rope is preferably attached to the handle by means of a swivel, preferably a low friction swivel such as, for example, a small ball-bearing or the like, and many other types of simple mechanical joint constructions. One possibility is to have the end of the rape pass through a bore in a ball, the end being knotted and the knot located in a counterbore of the ball to prevent the knot from protruding beyond the outline of the ball. The ball may then be received in a cup internally coated with low-friction material mounted on the end of the elongate part of the handle remote from the transverse part. The ball may be held captive in the cup by suitable means, and may also be constrained to rotate within the cup such that the axis of the rope lies within a certain solid angular range relative to the axis of the elongate portion of the handle. In an alternative construction, the end of the rope may be arranged to extend substantially transversely to the axis of the elongate portion of the handle. For example, the rope may be fixed at each end to a swivel collar which, via a suitable low friction bearing, is mounted on the end of the handle remote from the transverse portion.

In a further alternative, the rope end may have a suitable tab or collet attached thereto and the end of the elongate portion may have a socket into which the tab or collet may be filled in a way enabling its free rotation about the axis of the rope, but not enabling it to be extracted axially from the elongate portion of the handle.

The handles herein may be made of any convenient material or assembly of materials. The handle may be a unitary plastics molding.

A skipping rope in accordance with the invention is illustrated by way of example in the accompanying diagrammatic drawings.

DETAILED DESCRIPTION OF THE PRESENTLY PREFERRED EMBODIMENT

Figure 1:
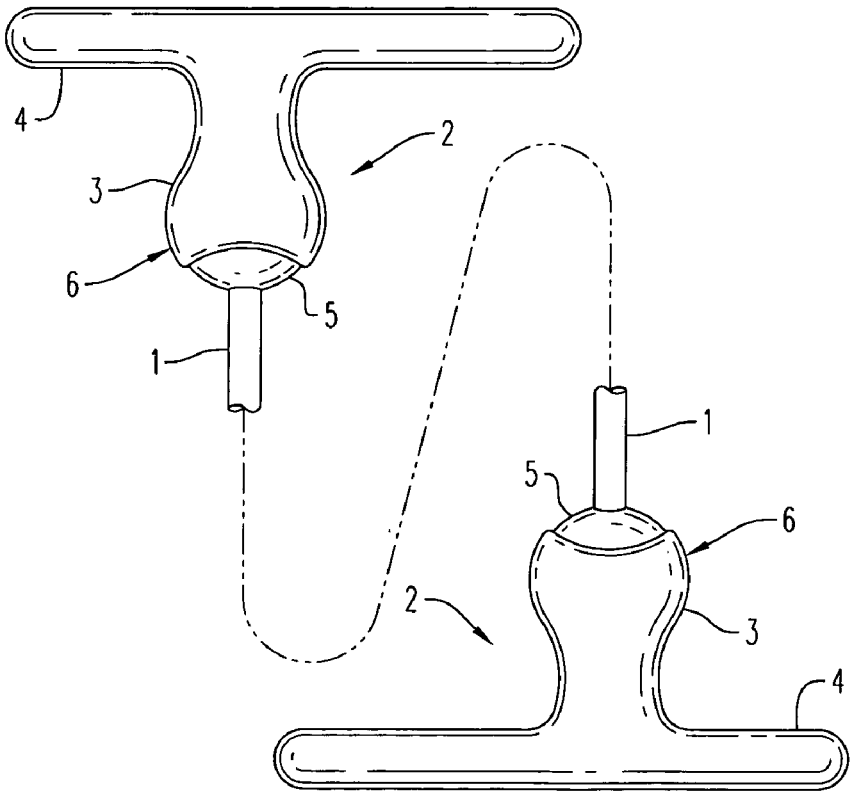
FIG. 1 is a side view of a skipping rope having at each end an asymmetric handle in accordance with the present invention, with the majority of the rope (indicated by a dotted line) omitted for clarity.

Reference is now made to FIG. 1, wherein a rope 1 has on each end a handle 2. Each handle includes an elongate portion 3 which is adapted to be placed between the fingers with a transverse portion 4 then resting inside the hand of a skipper (user). The ends of rope are attached to a rotatable ball 5 which is set in a cup 6 at the end of elongate portion 3. The materials of ball 5 and cup 6 are chosen to enable ball 5 to rotate with low friction. The end of rope 1 passes through a relatively close-fitting bore in ball 5 and may be held captive in the ball by any one of a number of suitable means, e.g. by a knot or other enlarged end portion which is located in an enlarged counterbore (shown in FIG. 2) in ball 5. The dimensions of ball 5 and cup 6 on the end of elongate portion 3 are such that ball 5 may be press-fitted into place using a force sufficient to enable that to occur, but without damaging the cup. The force to pull the rope 1 and ball 5 out of the cup being sufficiently high to ensure that the ball remains captive even at high skipping speeds. The length of elongate portion 3 is sufficient to hold the rope sufficiently far away from the back of the user's hand to avoid risk of the rope rubbing or chafing the user's hand.

Figure 2:
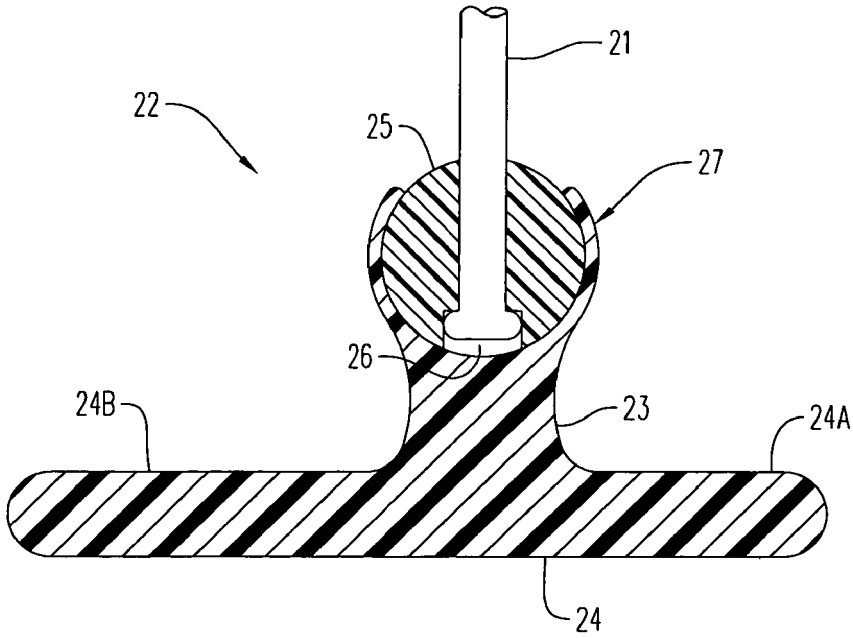
FIG. 2 is a longitudinal section through one of the handles shown in FIG. 1, showing a first embodiment of a handle in accordance herewith.

Reference is now made to FIG. 2, wherein a rope 21 has on each end thereof a handle 22. Each handle 22 includes an elongate portion 23 which is adapted to be placed between the fingers with a transverse portion 24 then resting inside the hand of the skipper. Note that transverse portion 24 has sub-portions 24A and 24B. The sub-portions 24A and 24B being sized i.e. by dimensioning a sub-portion of the transverse portion such that, when the handle is held such that the elongate portion passes between the first and second fingers, the sub-portions of the transverse portion are long enough to be in contact not only with the first (i.e., index) finger and second (i.e., middle) finger, but with the index finger, middle, third (i.e., ring), and fourth (i.e., little) fingers. Similarly, when the handle is held such that the elongate portion passes between the little finger and the ring finger, the sub-portions are long enough to be in contact not only with the little finger and the ring finger, but with the little finger, ring, middle, and index fingers.

The ends of the rope are attached to a rotatable ball 25 which is set in a cup 27 at the end of portion 23. The materials of ball 25 and cup 27 are chosen to enable the ball to rotate with low friction. The end of rope 21 passes through a relatively close-fitting bore in ball 25 and is held captive in ball 25 by a knot or other enlarged end portion which is located in an enlarged counterbore 26 in ball 25. The dimensions of ball 25 and cup 27 on the end of elongate portion 23 are such that ball 25 may be press-filled into place using a force sufficient to enable that to occur, but without damage to the cup, the force to pull the rope 21 and ball 25 out of cup 27 being sufficiently high to ensure that the ball remains captive even at high skipping speeds.

The length of elongate portion 23 is sufficient to hold the rope sufficiently far away from the back of the user's hand to avoid risk of the rope rubbing or chafing the user's hand.

Figure 3:
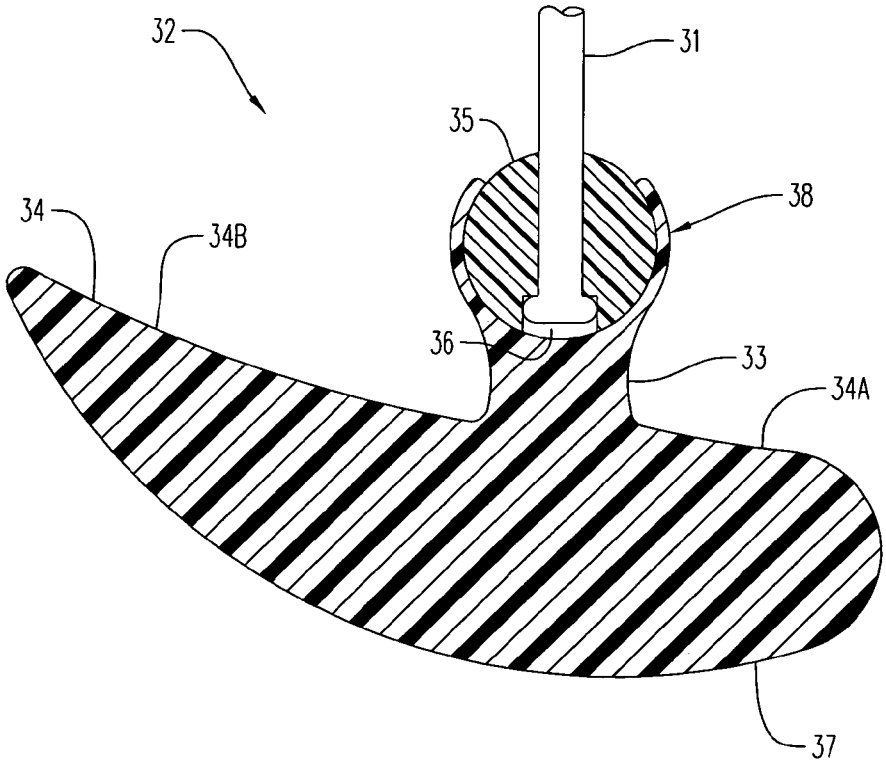
FIG. 3 is a longitudinal section of a handle in accordance with a second embodiment of a handle, herein.

Reference is now made to FIG. 3, wherein a rope 31 has on each end thereof a handle 32. Each handle 32 includes an elongate portion 33 which is adapted to be placed between the fingers with a transverse portion 34 then resting inside the hand of the skipper. Note that transverse portion 34 is of a teardrop shape, and, similar to the handle shown in connection with FIG. 2, has sub-portions 34A and 34B. The sub-portions 34A and 34B are sized to enable grasping of the handle with elongate portion 33 being disposed between two fingers other than the middle and ring fingers and with the teardrop shape of transverse portion 34 conforming comfortably to the palm, and in particular having surface 37 which is especially adapted to fit the palm.

The ends of rope 31 are attached to a rotatable ball 35 which is set in a cup 38 at the end of elongate portion 33. The materials of ball 35 and cup 38 are chosen to enable the ball to rotate with low friction. The end of rope 31 passes through a relatively close-fitting bore in ball 35 and is held captive in the ball by a knot or other enlarged end portion which is located in an enlarged counterbore 36 in ball 35. The dimensions of ball 35 and cup 38 on the end of portion 33 are such that ball 35 may be press-fitted into place using a force sufficient to enable that to occur, but without damaging cup 38. The force to pull the rope 31 and ball 35 out of cup 38 being sufficiently high to ensure that the ball remains captive even at high skipping speeds.

The length of elongate portion 33 is sufficient to hold the rope sufficiently far away from the back of the user's hand to avoid risk of the rope rubbing or chafing the user's hand.

Figure 4:
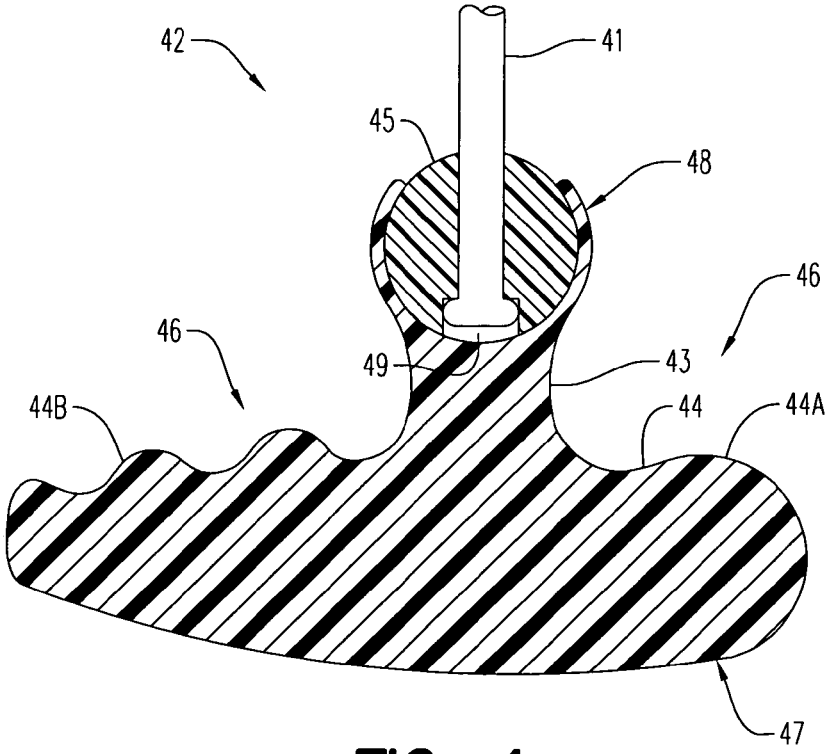
FIG. 4 is a longitudinal section through a handle in accordance with a third embodiment of a handle herein.

Reference is now made to FIG. 4, wherein a rope 41 has on each end thereof a handle 42. Each handle 42 includes an elongate portion 43 which is adapted to be placed between the fingers with a transverse portion 44 then resting inside the hand of the skipper. Note that transverse portion 44 has a side which has arcuate depressions 46 in a pattern resembling waves. Similar to the handle shown in connection with FIG. 2, handle 42 has sub-portions 44A and 44B, sub-portions 44A and 44B being sized to enable grasping of the handle with elongate portion 43 being disposed between two fingers other than the middle two fingers and with the wave-shaped surfaces 46 of transverse portion 44 accommodating the fingers of the user and with the other side of transverse portion 44 conforming comfortably to the palm, and in particular having surface 47 which is especially adapted to fit the palm.

The ends of the rope are attached to a rotatable ball 45 which is set in a cup 48 at the end of elongate portion 43. The materials of the ball and cup 48 are chosen to enable ball 45 to rotate with low friction. The end of rope 41 passes through a relatively close-fitting bore in ball 45 and is held captive in the ball by a knot or other enlarged end portion which is located in an enlarged counterbore 46 in ball 45. The dimensions of ball 45 and cup 48 on the end of elongate portion 43 are such that the ball may be press-fitted into place using a force sufficient to enable that to occur, but without damaging cup 48. The force to pull the rope 41 and ball 45 out of cup 48 being sufficiently high to ensure that ball 45 remains captive even at high skipping speeds. The length of elongate portion 43 is sufficient to hold the rope sufficiently far away from the back of the user's hand to avoid risk of the rope rubbing or chafing the user's hand.

Figure 5A:
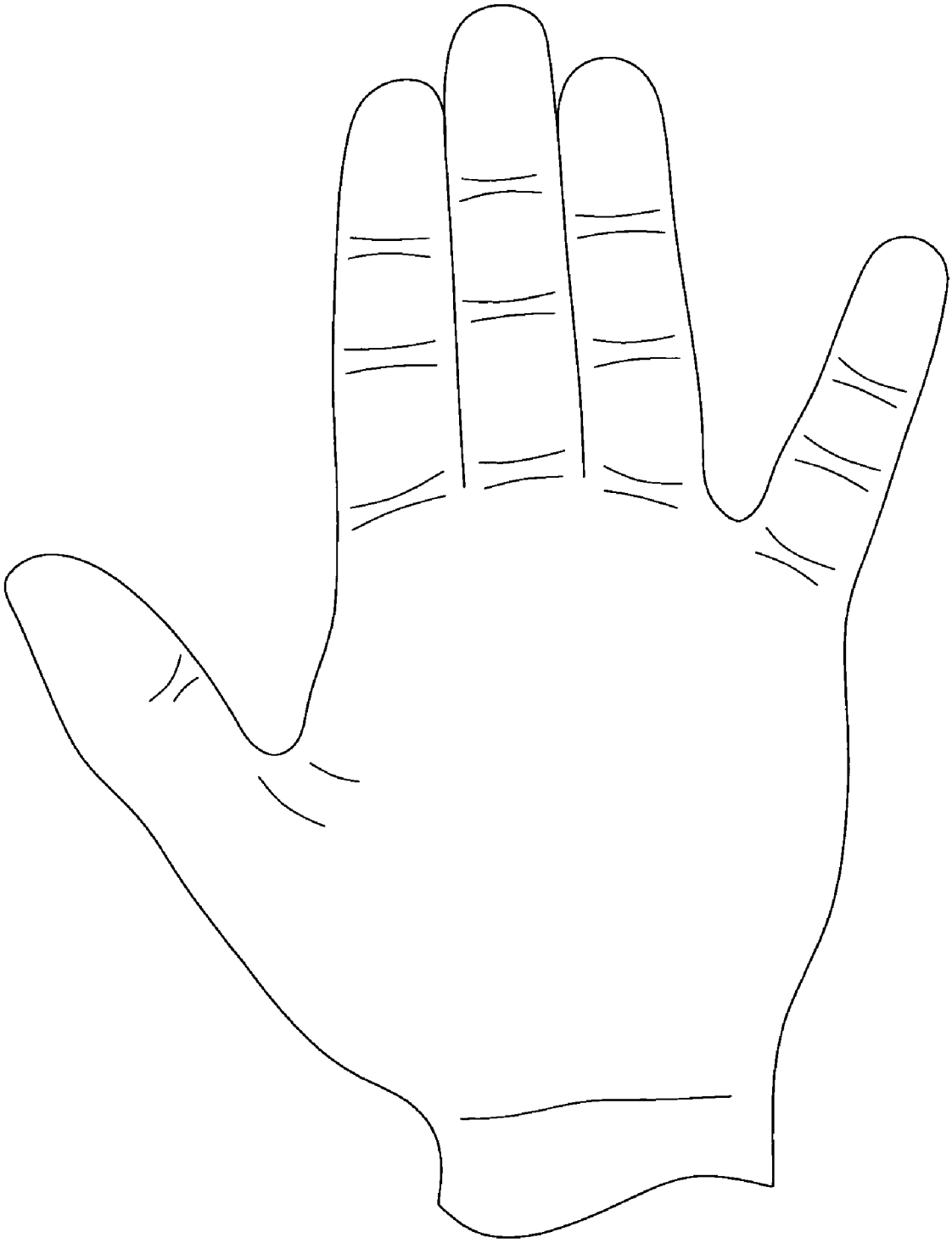
FIG. 5A is a plan view of a palm (ventral) side of a hand, shown with the ring finger and the little finger moved apart from one another so as to accommodate an elongate member of a handle herein therebetween.

Reference is now made to FIG. 5A, which depicts a palm (ventral) side of a hand, shown with the ring finger and the little finger moved apart from on another so as to accommodate the elongate member of a handle therebetween.

Figure 5B:
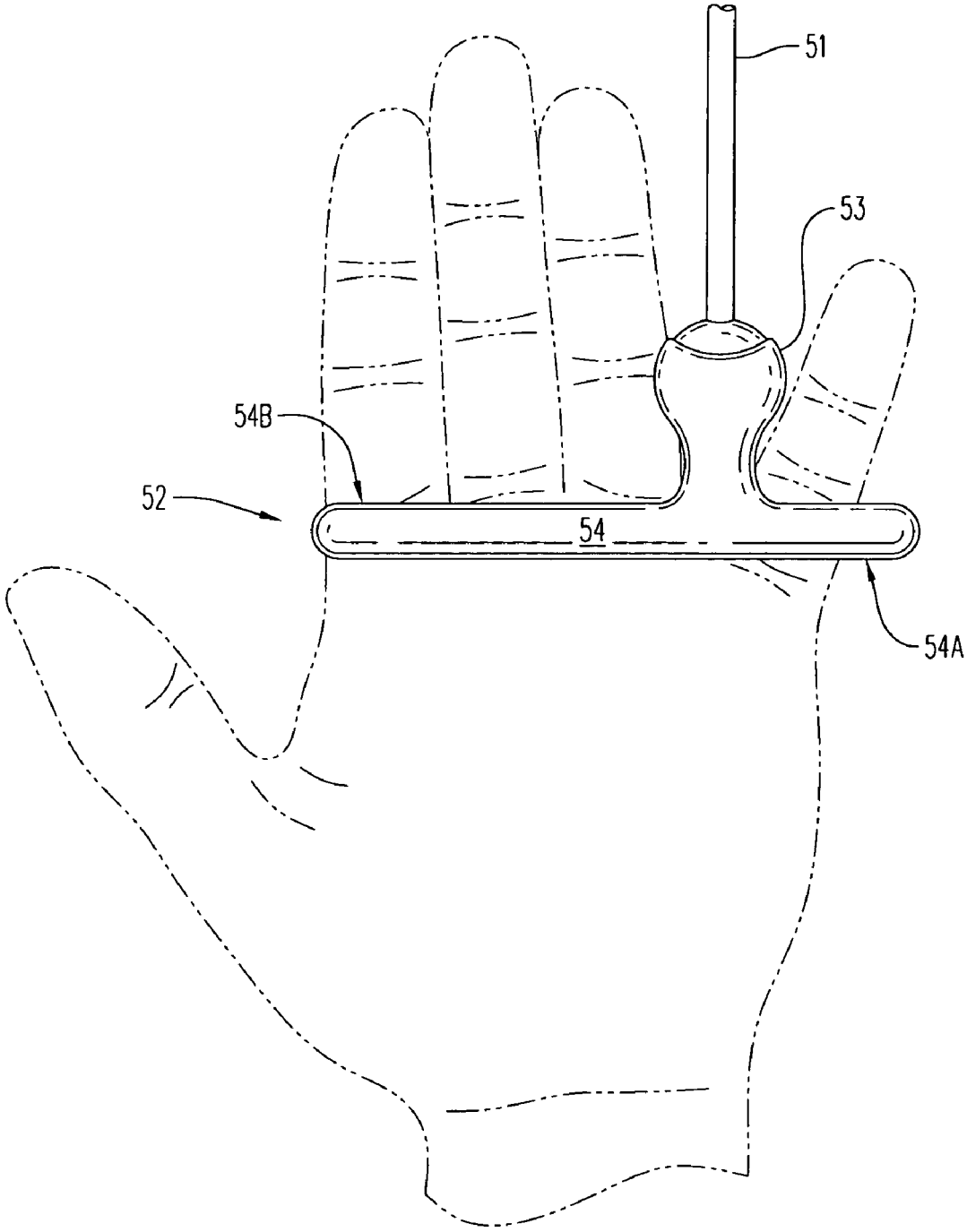
FIG. 5B is a plan view a handle of a skipping rope, in accordance with the present invention laid in the open palm depicted in FIG 5A.

Reference is now made to FIG. 5B, which is a view showing a handle of a rope according to the present invention laid in the open palm depicted in FIG 5A, having on its end a handle 52. Each handle 52 includes an elongate portion 53 which is adapted to be placed between the fingers with a transverse portion 54 then resting inside the hand of the skipper.

Figure 5C:
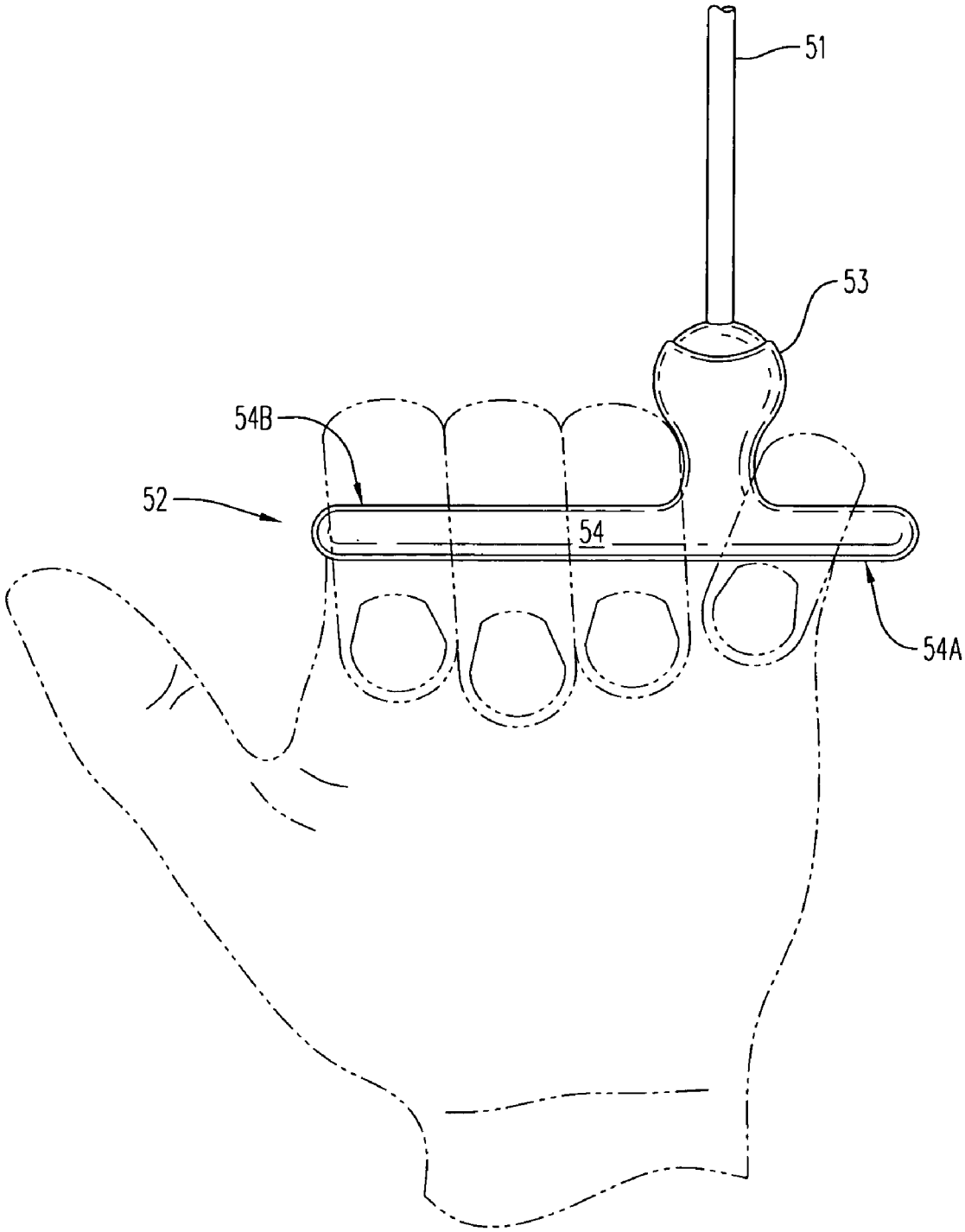
FIG. 5C is a plan view a handle of a rope in accordance with the present invention, held in the hand depicted in FIGS. 5A and FIG. 5B in a closed position.

Reference is now made to FIG 5C. Note that transverse portion 54 has sub-portions 54A and 54B, the sub-portions 54A and 54B being sized asymmetrically such that, when the handle is held such that the elongate portion passes between the little finger and the ring finger, the transverse portion 54 is sized so that one sub-portion 54A is sized to be in contact with the little finger and the ring finger, and the other sub-portion 54B is sized so as to be in contact with the ring, middle, and index fingers.

To demonstrate an alternative embodiment, the ends of the rope 51 are not shown attached to a rotatable ball set in a cup at the end of elongate portion 53. Instead, the end of rope 51 is shown simply connected to elongate portion 53. The length of elongate portion 53 is sufficient to hold the rope sufficiently far away from the back of the user's hand to avoid risk of the rope 51 rubbing or chafing the user's hand.

Figure 6A:
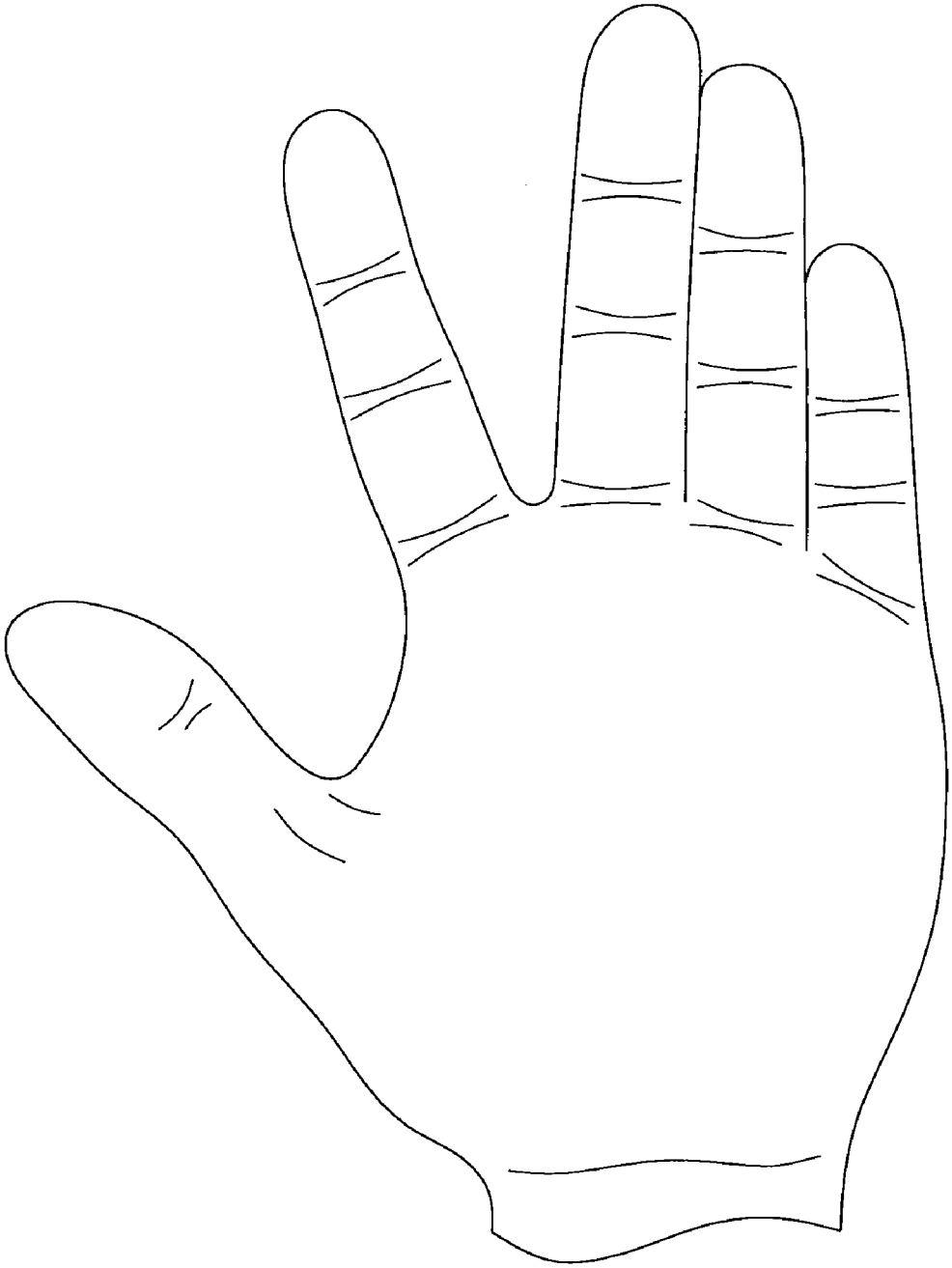
FIG. 6A is a plan view of a palm (ventral) side of a hand, shown with the index finger and the middle finger thereof moved apart from one another so as to accommodate an elongate member of a handle herein therebetween.

Reference is now made to FIG. 6A, which is a plan view of the palm (ventral) side of a hand, with the index finger and the middle finger moved apart from one another so as to accommodate an elongate member of a handle therebetween.

Figure 6B:
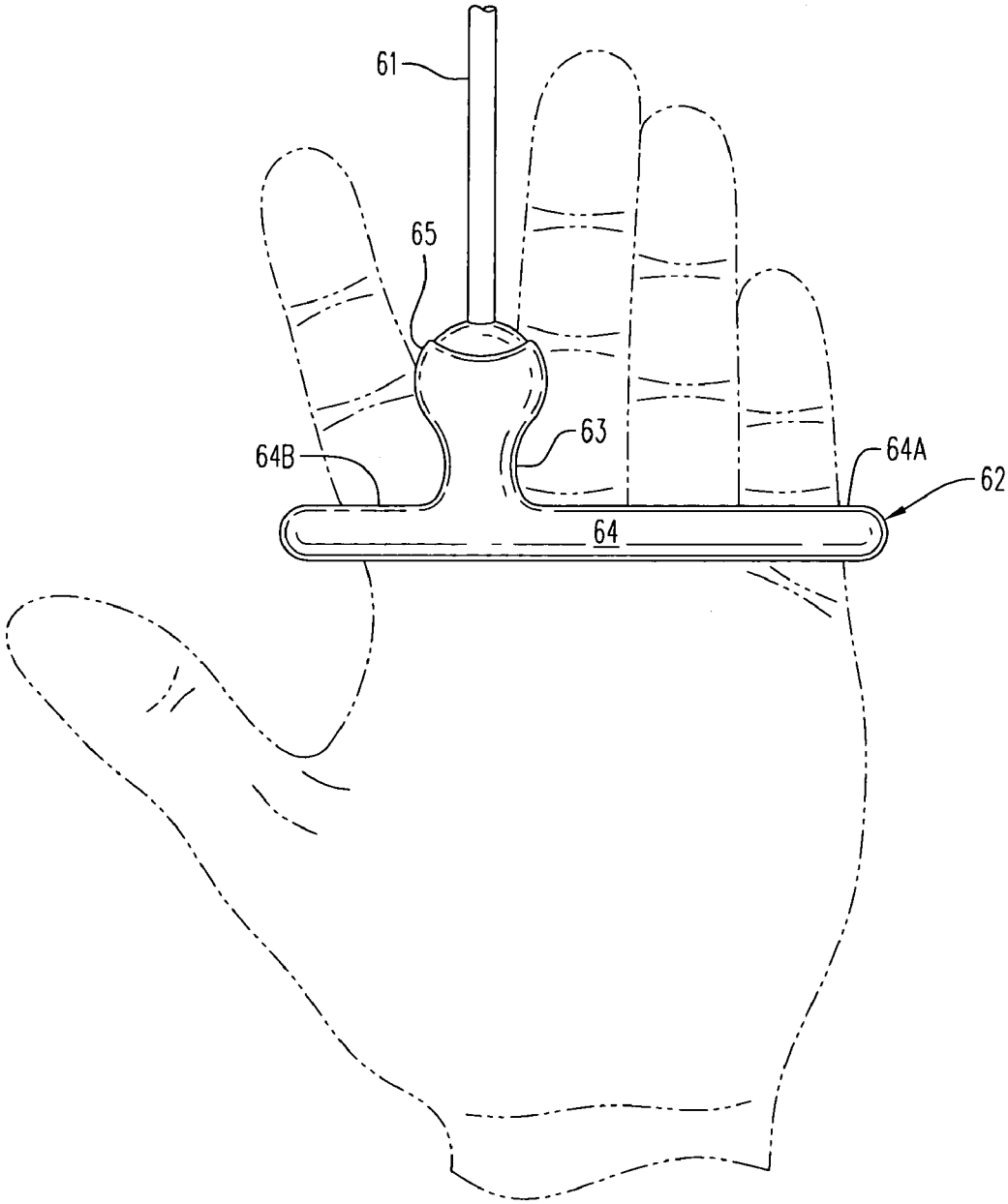
FIG. 6B is a plan view a handle of a rope in accordance with the present invention, laid in the open palm depicted in FIG 6A.

Reference is now made to FIG. 6B, is a view showing a handle 62 attached to a rope 61, laid in the open palm depicted in FIG. 6A. Rope 61 has a handle 62 attached to the ends thereof. Each handle 62 includes an elongate portion 63 which is adapted to be placed between the fingers with a transverse portion 64 then resting inside the hand of the skipper.

Figure 6C:
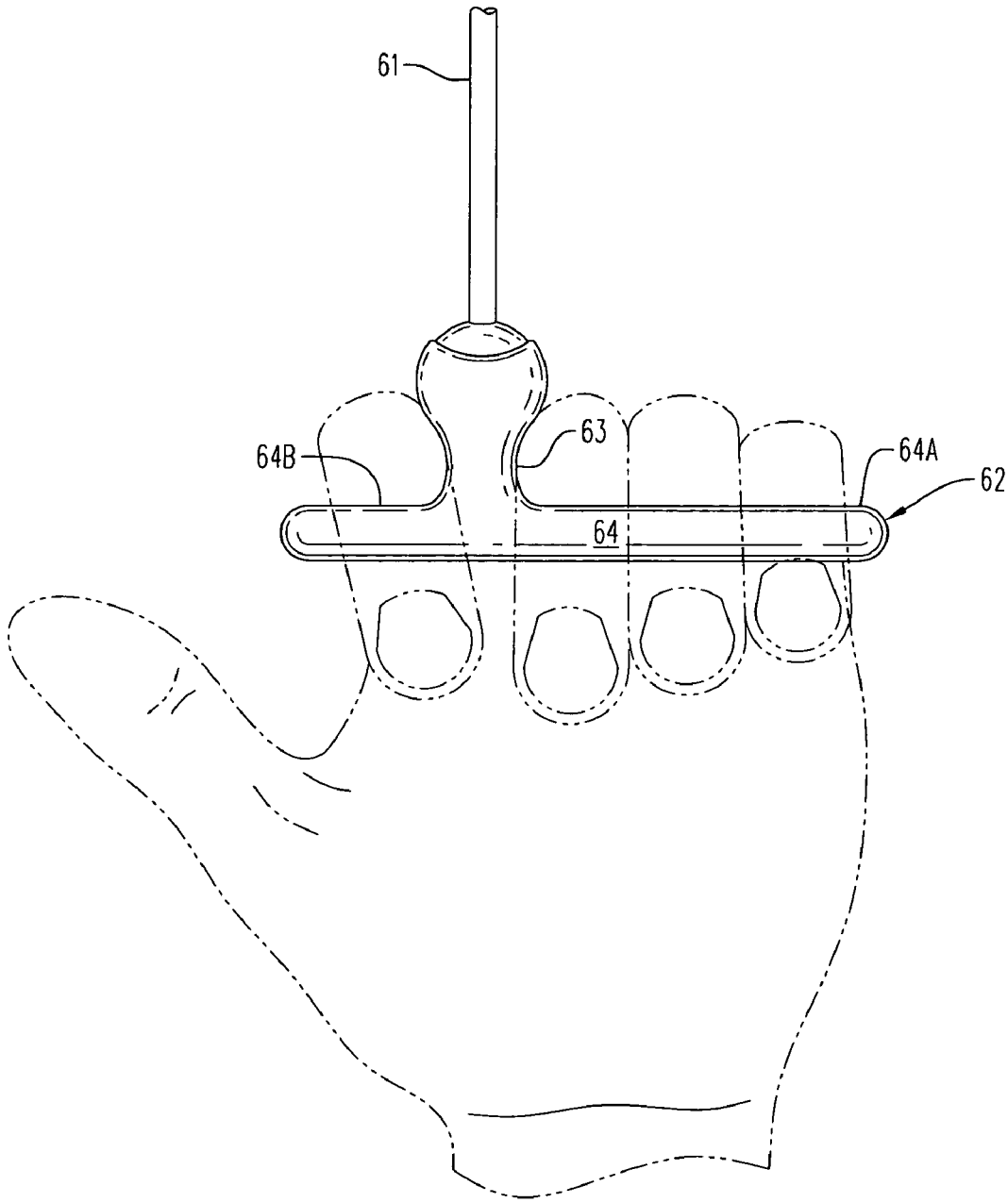
FIG. 6C is a plan view showing the handle of a rope in accordance with the present invention, held in the hand depicted in FIGS. 6A and 6B, in a closed position.

Reference is now made to FIG 6C. Note that transverse portion 64 has sub-portions 64A and 64B, said sub-portions 64A and 64B being sized asymmetrically such that, when the handle is held such that the elongate portion 63 passes between the index finger and the middle finger, the transverse portion 63 is sized so that one sub-portion 64A is sized to be in contact with the little finger, the ring finger, and the middle finger and the other sub-portion 64B is sized so as to be in contact with the middle and index fingers.

To demonstrate an alternative embodiment, the ends of rope 61 are not shown attached to a rotatable ball set in a cup at the end of portion 63. Instead, the end of rope 61 is shown simply connected to elongate portion 63. The length of elongate portion 63 is sufficient to hold the rope sufficiently far away from the back of the user's hand to avoid risk of the rope rubbing or chafing the user's hand.

The invention claimed is:

1. A skipping rope comprising:

a length of rope including flexible material;

a pair of handles, each handle having an elongate portion rotatably connected to an end of the rope at a first end of the elongate portion and connected to a transverse portion at a second end of the elongate portion, wherein the elongate portion asymmetrically bisects the traverse portion into two sub-portions, one being of greater extent than the other, and the handle is adapted to fit in a hand holding it such that the elongate portion extends between two fingers other than the second (middle) and third (ring) fingers, and wherein each elongate portion further comprises a ball that rotatably connects to the rope, wherein each ball has an end of the rope passing through at least a portion of the ball.

2. A skipping rope according to claim 1, wherein the elongate portion of each handle further comprises a cup for receiving the ball and retaining the ball therein.

3. A skipping rope according to claim 1, wherein the handle comprises a unitary plastics molding.

4. A skipping rope according to claim 1, wherein the transverse portion is substantially teardrop-shaped.

5. A skipping rope according to claim 1, wherein the transverse portion comprises at least one surface having a plurality arcuate depressions thereon to accommodate fingers of the hand.

6. A skipping rope according to claim 1, wherein the elongate portion is of a length sufficient to position the rope away from the fingers between which the elongate portion extends.

7. A skipping rope handle comprising:

an elongate portion;

a traverse portion connected to the elongate portion, wherein the elongate portion asymmetrically bisects the traverse portion into two sub-portions, one sub-portion being of greater extent than the other sub-portion, and the handle is adapted to fit in a hand holding it such that the elongate portion extends between two fingers other than the second (middle) and third (ring) fingers of the hand; and a rotatable connector, including a ball, located at an opposing end of the elongate portion from the traverse portion to rotatably connect to an end of length of skipping rope material.

8. The handle of claim 7, wherein the rotatable connector further comprises a cup for receiving and retaining the ball therein.

9. The handle of claim 7, wherein the transverse portion is substantially teardrop-shaped.

10. The handle of claim 7, wherein the transverse portion comprises an outer surface area having a plurality of arcuate voids therein to accommodate fingers of a hand.

11. The handle of claim 7, wherein, when the handle is held in a hand, one of the sub-portions contacts three fingers and the other sub-portions contacts one finger.

* * * * *

UNITED STATES PATENT AND TRADEMARK OFFICE

CERTIFICATE OF CORRECTION

PATENT NO. : 7,169,091 B2
APPLICATION NO. : 10/372760
DATED : January 30, 2007
INVENTOR(S) : St. George et al.

It is certified that error appears in the above-identified patent and that said Letters Patent is hereby corrected as shown below:

Column 6, line 1: Replace reference numeral “46” with -- 49 --.

Signed and Sealed this

Fifteenth Day of May, 2007

JON W. DUDAS
*Director of the United States Patent and Trademark Office*